US005813117A

United States Patent [19]

Natali

[11] Patent Number: 5,813,117

[45] Date of Patent: Sep. 29, 1998

[54] METHOD OF MAKING A FLEXIBLE CONTACT TAB

[76] Inventor: Gianfranco Natali, 1, Via Roma, I-06019 Umbertide-Perugia, Italy

[21] Appl. No.: 796,109

[22] Filed: Feb. 5, 1997

[30] Foreign Application Priority Data

Feb. 26, 1996 [IT] Italy ..... AR96A0006

[51] Int. Cl.[6] ..... H01R 43/16

[52] U.S. Cl. ..... 29/874; 29/622; 29/882

[58] Field of Search ..... 29/874, 882, 622

[56] References Cited

U.S. PATENT DOCUMENTS

| | | | |
|---|---|---|---|
| 3,878,347 | 4/1975 | Roeser . | |
| 3,995,365 | 12/1976 | Repplinger | 29/882 |
| 4,118,610 | 10/1978 | Purssell | 29/622 X |
| 4,145,587 | 3/1979 | Purssell | 29/622 X |
| 4,250,367 | 2/1981 | Rossi | 29/622 X |
| 5,666,723 | 9/1997 | Ohtaka et al. | 29/874 |

*Primary Examiner*—Carl J. Arbes
*Attorney, Agent, or Firm*—Young & Thompson

[57] ABSTRACT

A tab (2) obtained from plate (1) from which it emerges through a process which includes a first shearing phase, with which the elongated vent hole (6) is carried out, a second coining phase with which the impression (4) and the protruding contact button (5) are obtained around the elongated vent hole (6), a second shearing phase with which the work hardened—reduced thickness metal is cut along the line which defines the tab (2) which is inflected and made to protrude from the surface (9) of the plate (1) on the side of the impression (4). On the three sheared off sides, the tab (2) is smaller than the impression (4) to allow it to deflect freely in the said impression (4) when it is undergoing stress.

8 Claims, 1 Drawing Sheet

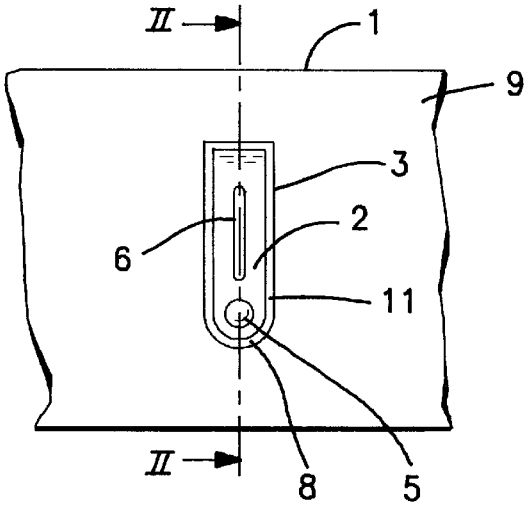
FIG. 1
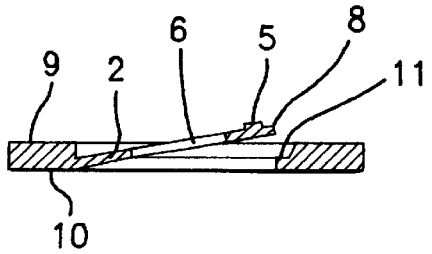
FIG. 2
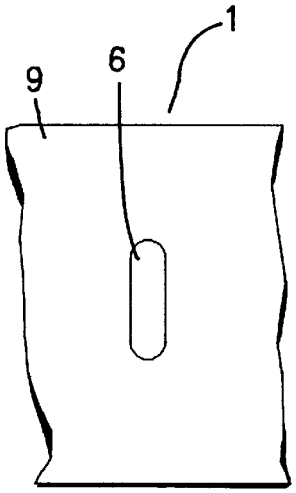
FIG. 3
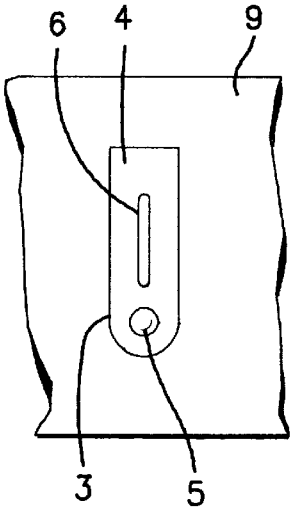
FIG. 4
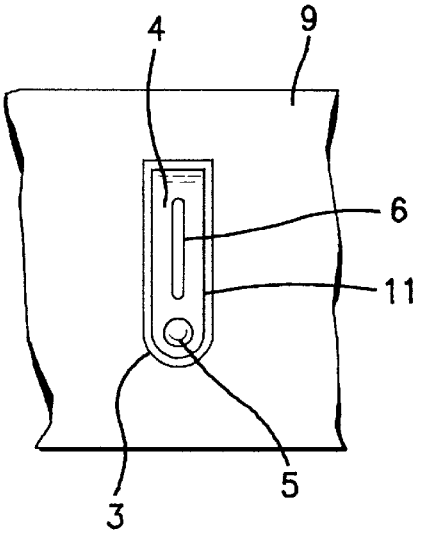
FIG. 5
FIG. 6
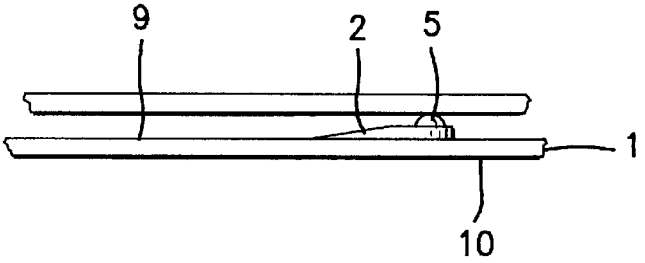

METHOD OF MAKING A FLEXIBLE CONTACT TAB

BACKGROUND OF THE INVENTION

1. Field of the Invention

The invention consists in an elastic flexible contacting tab and the process through which it is obtained from a metal plate, from which it protrudes, to adhere, when operating, to another plate and/or to other means placed close to it with which to carry out a mechanical or electrical contact.

2. Description of the Related Art

It is common knowledge that an electric or mechanic contact is carried out between metal parts placed close to each other by means of elastic flexible metal tabs.

Existing elastic flexible tabs are formed in one case, by a thin metal strip, normally having a Z shape, fixed to a metal structure with a rivet on one end, which usually is the main surface of a metal frame.

While the other end remains free and protrudes to adhere—when operating—to the part to contact. In a second case the tab is obtained directly from the metal plate, from which it should protrude, through a process which includes a number of phases for shearing-edge making, partial and localized coinage and for inflecting.

With the shearing-edge making operation some metal is eliminated in order to create a strip of which one end is attached to the plate from which it's obtained, and an empty space along three of its sides. With the partial and localized coinage, in correspondence to the side on which it is attached to the plate, the strip consequently becomes elastic.

With the inflection operation the strip is formed so as to assume the shape of a tab that is adequately bent, to make it protrude from the plate from which it is made to allow it to adhere to another plate or to another element to be contacted, in a specific point.

Existing tabs and the processes through which they are made develop some disadvantages.

The tab of the first type requires a specific production, followed by its positioning on the plate on which it must be fixed, therefore it is soldered or—frequently—fixed to the plate with a rivet after holes are punched through it, or snap fixed on a specific space.

A part from the complexity of its production, of its positioning and anchoring, it is also entirely protruding from the plate on which it is anchored so that during and after its assembly it could be hit/banged into and because of its thinness, ruined, or the person handling it could accidentally hit/bang into it and could get hurt.

The tab of the second type is obtained directly from the plate on which it should operate, through a traditional shearing-edge making process with which a relatively wide empty space is created around the tab which in certain cases ends up being very thin, therefore weak, because of the insufficient space available.

The wide space existing on the three sides of the tab can cause on one hand, the protruding tab to stick to surrounding objects or on the hands of who is handling it, while on the other hand it is a non-acceptable means of passage and exit for some uses. Furthermore, the acute corner produced during the shearing stage could cause injuries by accidental banging against it on behalf of the worker.

SUMMARY OF THE INVENTION

The aim of the present invention is to realize an elastic/flexible contact tab protruding from a metal plate, at low cost, of fast execution and shaped in such a way as to ensure both the contact with another plate or metal element, and the preservation of its functionality after its handling during production and its marketing, even when carried out without specific precautions and attention.

Another aim is to ensure the safety of the operator that will handle it, without the protruding tab and its thin structure being the cause of injuries to the hands of those who will handle them.

One more aim is to realize a tab which operates with almost non-existent apertures or spaces to avoid any passage of electromagnetic waves, objects or bodies.

The invention which allows us to obtain said results consists in a tab obtained from the plate from which it protrudes through a process which includes a first shearing phase, with which an elongated vent hole is obtained, a second coining phase with which an impression and a protruding contact button, are realized around an elongated vent hole (which is partially closed), a second shearing phase with which the work hardened—reduced thickness metal is cut along the line which defines the tab, on the side opposite to the one on which the tab is realized, and inflected until it protrudes from the surface of the plate on which the impression is made.

The advantages offered by the invention consist in the fact that:

- the tab has a protruding rounded button which enables us to obtain a good elastic contact with the other close metal elements and at the same time its shape excludes the possibility of injuring one who accidentally brushes against the tab when handling it;
- the thinned out tab protrudes from the surface of the plate from which it is obtained so that when it is stimulated by the counterpart it inflects within the impression originated by the coinage phase, thus avoiding its protrusion, when needed;
- the tab presents its sharp cutting edge, produced during the second shearing phase, turned towards the inside of the impression, therefore in a protected position for the user, thus avoiding hurting the person handling it;
- the empty spaces around the tab are minimal so that when it is bent inwards inside the impression they are practically eliminated.

The tab, with its capacity to inflect within the coined impression, with its protruding button shaped contact and activation point, normally with a limited projection towards the outside of the plate surface, due to the fact that sharp border edges are hidden and not reachable by the person handling the plate, it is made safe in its use and handling so that it is particularly advantageous in respect to the present techniques.

BRIEF DESCRIPTION OF THE DRAWINGS

The invention is described in detail herebelow with the aid of the drawings which represent the preferred production shape and the phases with which it is produced and in which:

FIG. 1 is the layout view of a portion of the plate on which the impression and the elastic flexible tab are positioned;

FIG. 2 is the elevated view of the portion of the plate in FIG. 1 cut along the line AA;

FIG. 3, reproducing the first slotting phase of the production process, is the layout view of the portion of plate on which, with the first slotting operation, the first physical elongated vent hole is obtained;

FIG. 4, reproducing the coinage phase of the production process, is the layout view of the portion of the plate in FIG.

3 on which, around the physical elongated vent hole, by means of a coinage operation, the impression with the protruding contact button is obtained;

FIG. 5, reproducing the second slotting phase of the production process, represents the layout view of the plate in FIG. 4 after it has undergone the second slotting phase;

FIG. 6 is the elevated view of two plates facing each other in contact with the elastic flexible tab emerging from one of the two.

It must be well understood, in any case, that the drawings and the corresponding described parts are given only so as to illustrate the object of the invention without, in any way constituting any limitation.

DETAILED DESCRIPTION OF THE PREFERRED EMBODIMENTS

In the drawings, we have indicated with 1, the supporting plate, with 2 the flexible tab, with 3 the line limiting the impression 4, with 5 the protruding contact button, with 6 the elongated vent hole for the material that is compressed during the coinage phase, with 8 the free end of the tab 2, with 9 the upper surface of the plate 1, with 10 the lower surface, with 11 the space contained between the edge lines 3 of the impression 4 and those of the edge of the tab 2.

The invention consists therefore in a particular structure and shape of the flexible and elastic tab 2, emerging from the plate 1, whichever way it is shaped or structured, of which it is part.

The invention also consists in the particular procedure through which the tab 2, which is an integral part of the same plate 1, is made. The tab protrudes from the plate 1 and has elastic properties so that, when it is pressed by extraneous bodies, it inflects and remains in contact with the same extraneous bodies; at the same time it is pushed towards the impression 4 from which it emerges to the point of re-entering it, if necessary, even for the totality, in this case closing the opening from which the tab 2 is made, almost completely.

The procedure with which the tab is made requires a first slotting phase (FIG. 3) with which on plate 1 an ample elongated vent hole 6 is made, a coinage phase (FIG. 4) in which, around the elongated vent hole 6, the impression 4 and the protruding contact button 5 are made, a second slotting and bending phase with which the metal, with reduced thickness and work hardened in impression 4, is cut along the line which defines the outline of the tab 2 and it is made to protrude on the side on which the impression itself is obtained. With the first shearing stage some metal is eliminated and the elongated vent hole 6 is carried out, its shape is usually elongated and it is positioned along the central axis of the tab 2 that will be obtained.

With the following coinage stage, the entire piece of metal corresponding to the impression 4 is deformed by compression and is work hardened until it is made elastic/flexible so that the obtained tab results flexible and elastic around its resting position while the thickness of the plate 1 is reduced in that area. In this stage the migration of metal which finds its outlet in elongated vent hole 6 occurs, therefore elongated vent hole 6 is reduced, so that initially it should have a dimension so as to allow its compression and therefore the carrying out of the needed impression 4.

A deep impression, normally half of the original thickness of the plate 1 to allow on the finished product, tab 2 to inflect when pushed, until occupying the same impression, without protruding from the area defined by surface 9 of the plate and without going back into the seat from where it was cut out during the second shearing stage, to avoid its getting stuck in it.

In the coinage stage the thinning of plate 1 in correspondence with impression 4 is obtained, and in a reduced manner the thinning is also obtained in the spot where—due to a cavity on the coining die—the accumulation of metal is determined cold flow, which produces the protruding button 5 on the tab 2, the button that facilitates the contact between the tab and other bodies.

The impression 4 is made with a size (width—length) larger than that of the flexible tab 2 to be produced, so that the line, along which the impression will be cut to originate the tab, will be inside the edge 3 that delimits the same impression, originating in this way, around the tab 2, the thin crown 11.

The coinage with which the impression 4 is created will have a die that will make the base of the impression of a constant thickness, excepting the protruding contact button 5, when one intends to obtain a tab that has a constant inflection capacity along its total length.

It will instead have a die shaped so that it will originate an impression with a non-uniform thickness and therefore a tab with minimal thickness in correspondence with the points in which the tab must have the highest inflective capacity, when one requires a tab that is capable of inflecting in different ways along its length.

The tab 2 is therefore made by shearing the impression 4 along the three sides therefore creating a raised structure. The shearing is carried out by means of a die cutter operating on the side 10 of plate 1, opposite to that on which the impression 4 is placed, so that the sharp edge of the tab 2 is inwards towards impression 4 and the sharp edge on the plate 1 remains inside the same impression.

In the event that the tab 2 has a dimension that is slightly smaller to that of impression 4, when therefore the crown 11 has minimal width, during the cutting phase, it is not necessary to use a matrix that corresponds perfectly to the sharp cutting die.

In the cutting operation the tab is bent towards the outside of the plate 1 and its initial part that remains jammed on the edge of the cavity from which the tab is obtained, blocks it in the desired resting position in which at least its contact button protrudes from the surface 9.

The sharp edge of the tab 2 remains therefore covered by the thickness of the same plate 1 so that contact between the said sharp edge and the person handling the same plate is avoided, while the opening will have a reduced dimension that will close almost completely when the tab is pressed inside the impression 4.

The tab that is structured and shaped in this way is an integral part of the plate 1, it has a central elongated vent hole with a small size derived from the original vent 6 which is partially filled due to the coinage process of plate 1, it presents the protruding button 5 towards its free end and is directed towards the outside of impression 4.

In some production solutions the tab 2 can have various contact buttons 5 towards its free end 8. In other solutions it could be shaped in its profile, from the elevated view, so as to favour the protrusion from the plate 1 and its contact with other bodies, without protruding contact buttons.

I claim:

1. A method of producing from a metal plate having an initial thickness, an elastic and flexible contact tab emerging from said metal plate, and designed to reach and contact another plate placed in close parallel proximity to said metal plate, comprising the steps of:

(a) shearing an elongated vent hole on said metal plate to a size that is sufficiently large to receive metal during a subsequent compression of metal surrounding said elongated vent hole;

(b) coining, from a first side of said metal plate, an area around said elongated vent hole to form a generally planar surface area defining a flexible contact tab surface area with a contact button surface area within said planar surface area, wherein said coining reduces the size of said elongated vent hole, hardens said planar surface area, and reduces the thickness of said planar surface area; and (c) shearing, from a second side of said metal plate, said planar surface area to obtain a line defining a shape of said flexible contact tab so that said flexible contact tab is defined and is made to protrude through said first side of said metal plate.

2. The method of claim 1, wherein said steps of coining and shearing an elongated vent hole center said elongated vent hole on a central axis of said flexible contact tab surface area.

3. The method of claim 1, wherein said coining step compresses said planar surface area such that metal in said planar surface area is made elastic.

4. The method of claim 1, wherein said coining step reduces the thickness of said planar surface area to half said initial thickness.

5. The method of claim 1, wherein said coining step further comprises coining additional area surrounding said flexible contact tab surface area so that during said step of shearing, from said second side of said metal plate, to obtain a line defining a shape of said flexible contact tab, said shearing is performed in said additional area.

6. The method of claim 1, wherein said coining is performed using a die head that is designed to provide said planar surface area with a first constant thickness and said contact button surface area with a second thickness greater than said first constant thickness.

7. The method of claim 1, wherein said coining is performed using a die head shaped to provide said planar surface area with a tab-to-plate connection area having a thickness providing said tab-to-plate connection area with a higher inflection capacity than the remainder of said planar surface area so that when said shearing, from said second side of said metal plate, to obtain a line defining a shape of said flexible contact tab, occurs, a tab-to-plate connection with a higher inflection capacity is formed.

8. The method of claim 1, wherein said shearing, from said second side of said metal plate, of said planar surface area is performed using a cutting die operating from said second side so that said flexible contact tab is created and said flexible contact tab protrudes through said first side of said metal plate.

* * * * *